United States Patent [19]

Angel

[11] Patent Number: 5,076,415

[45] Date of Patent: Dec. 31, 1991

[54] COIN OPERATED DEVICE

[75] Inventor: John B. Angel, Torquay, England

[73] Assignee: Coinmechs Limited, Devon, United Kingdom

[21] Appl. No.: 506,630

[22] Filed: Apr. 9, 1990

[30] Foreign Application Priority Data

Mar. 6, 1989 [GB] United Kingdom ..... 8905052
Nov. 15, 1989 [GB] United Kingdom ..... 8925834

[51] Int. Cl.[5] ..... G07D 5/02
[52] U.S. Cl. ..... 194/336; 194/301
[58] Field of Search ..... 194/293, 301, 336

[56] References Cited

U.S. PATENT DOCUMENTS 4,098,386 7/1978 Martin ..... 194/336
4,376,480 3/1983 Abe .
4,629,051 12/1986 Abe ..... 194/336 X

FOREIGN PATENT DOCUMENTS 690302 7/1964 Canada ..... 194/336
2309213 12/1973 Fed. Rep. of Germany .
2813183 7/1981 Fed. Rep. of Germany .
1252720 11/1971 United Kingdom .
1255041 11/1971 United Kingdom ..... 194/336

*Primary Examiner*—David A. Bucci
*Assistant Examiner*—William M. Hienz
*Attorney, Agent, or Firm*—Weingarten, Schurgin, Gagnebin & Hayes

[57] ABSTRACT

In a coin-operated device an inserted coin lodges in a tumbler member which is adjustable continuously or in discrete steps to cater for coins of a different denomination. Upon receipt of a valid coin, the tumbler member tilts to allow the coin to pass between the tumbler member and a pendulum member.

11 Claims, 4 Drawing Sheets

COIN OPERATED DEVICEcl BACKGROUND OF THE INVENTION

The present invention relates to devices operated by coins of a predetermined size and in particular to devices operated by coins of a chosen denomination. The term coins is taken to include all other tokens of exchange.

Automatic vending machines contain a mechanism to allow them to identify the coins or tokens inserted into them in exchange for goods or services. The present invention seeks to provide a simple, reliable and accurate mechanism for performing this task.

GB Patent 1252720 discloses a coin operated device comprising means defining a path for an inserted coin and a pivotable cradle member located in the path and comprising means defining a coin-receiving aperture.

SUMMARY OF THE INVENTION

According to a first aspect, the invention provides a coin-operated device comprising means defining a path for an inserted coin, and a pivotable member located in said path and comprising means defining a coin-receiving aperture, wherein the length of said aperture is adjustable.

According to a second aspect, the invention provides a coin-operated device comprising means defining a path for an inserted coin, two members in the path, said members being relatively-movable by a said coin of a correct denomination from a first position in which a said coin cannot pass between said two members and a second position in which a said coin can pass therebetween.

BRIEF DESCRIPTION OF THE DRAWINGS

In order that the invention and its various other features may be understood more easily, preferred embodiments thereof will now be described by way of an example only, with reference to the drawings, wherein.

DESCRIPTION OF THE PREFERRED EMBODIMENT

Basically the present invention relates to a coin-operated device comprising means defining a path for an inserted coin and a pivotable member located in the path and comprising means defining a coin-receiving slot or aperture characterised in that the length of said slot or aperture is adjustable.

The above device has the advantage that undersize coins are automatically rejected by falling through said slot or aperture. There is no need for a separate mechanism to remove them. Rejected coins can be returned to the user of the machine, or directed to a desired receptacle.

In a preferred embodiment the pivotable member is a tumbler and is mounted adjacent to a pendulum, the arrangement being such that an inserted coin of a correct denomination pivots said tumbler and pendulum in the same sense from a first position in which the coin cannot pass between them to a second position in which the coin can pass between them.

Thus a simple and reliable mechanism can be provided with a relatively simple pendulum which is freely suspended.

Preferably actuating means are also located in the path so as to be actuated by a coin which has passed between the members.

Both tumbler and pendulum members preferably return to their first positions after a coin has passed, e.g. under the effects of gravity.

In the first position of the pendulum, a part thereof may direct a coin to a position in which the coin can cause relative movement between the tumbler means and the pendulum.

Figure 1:
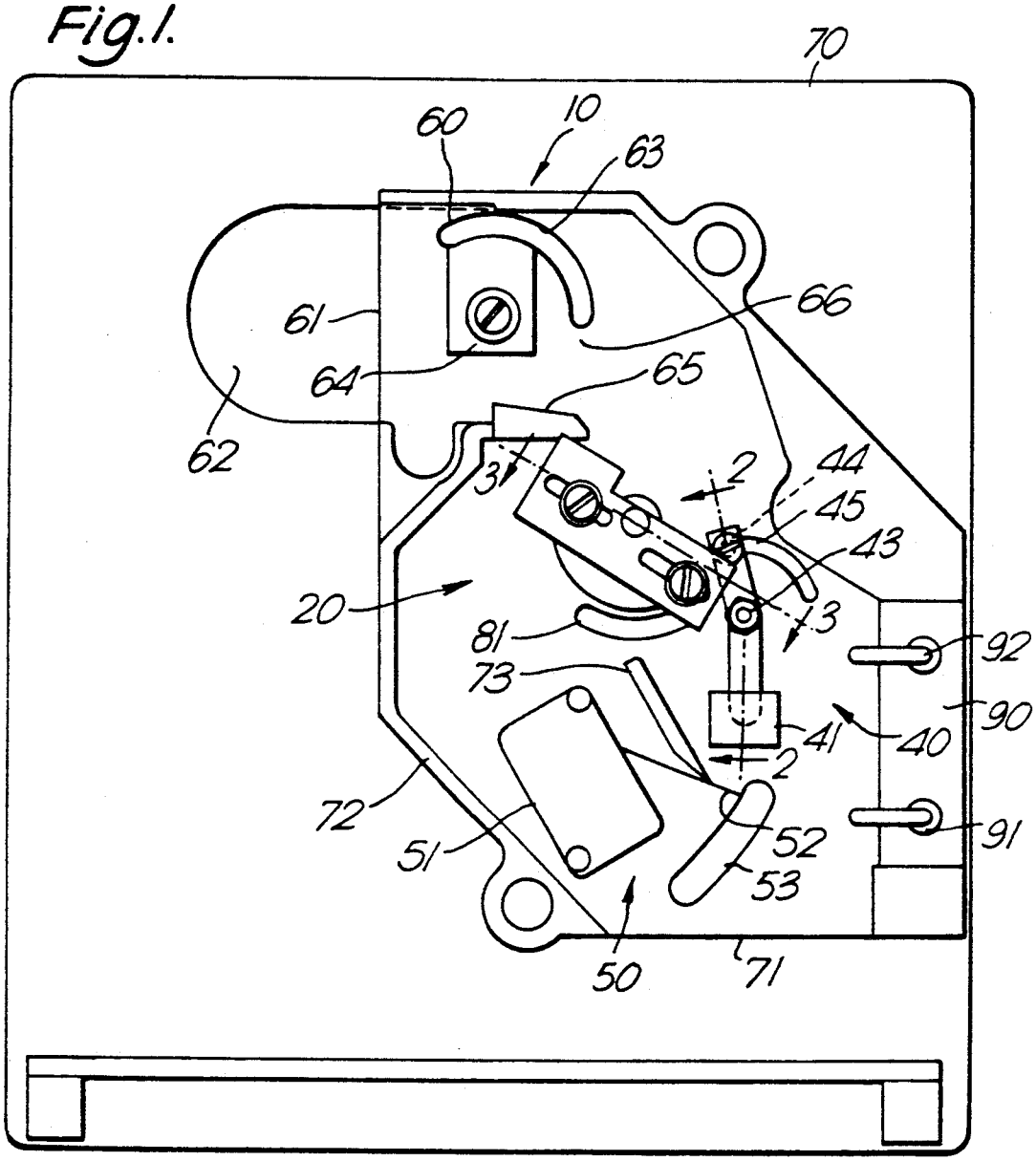
FIG. 1 is a front view of the device in accordance with a first embodiment of the present invention with a cover plate removed.
Figure 2:
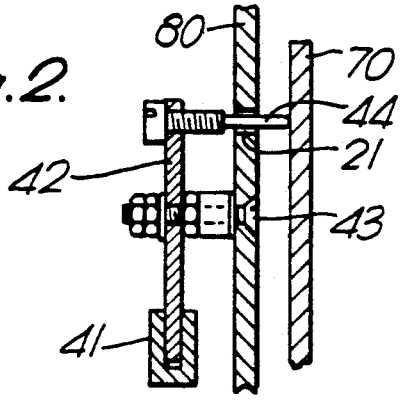
FIG. 2 is a cross sectional view of a pendulum along 2—2 in FIG. 1.
Figure 3:
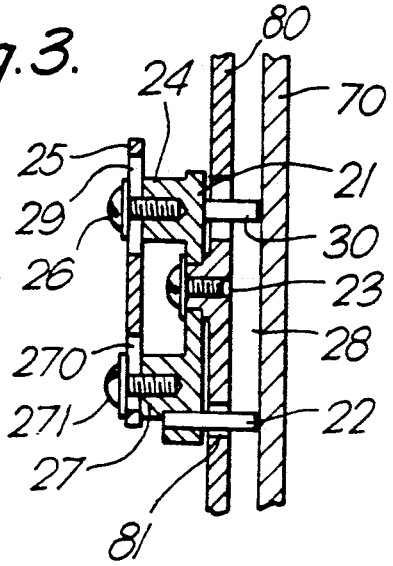
FIG. 3 is a cross sectional view of a tumbler member of the device along 3—3 in FIG. 1.
Figure 4:
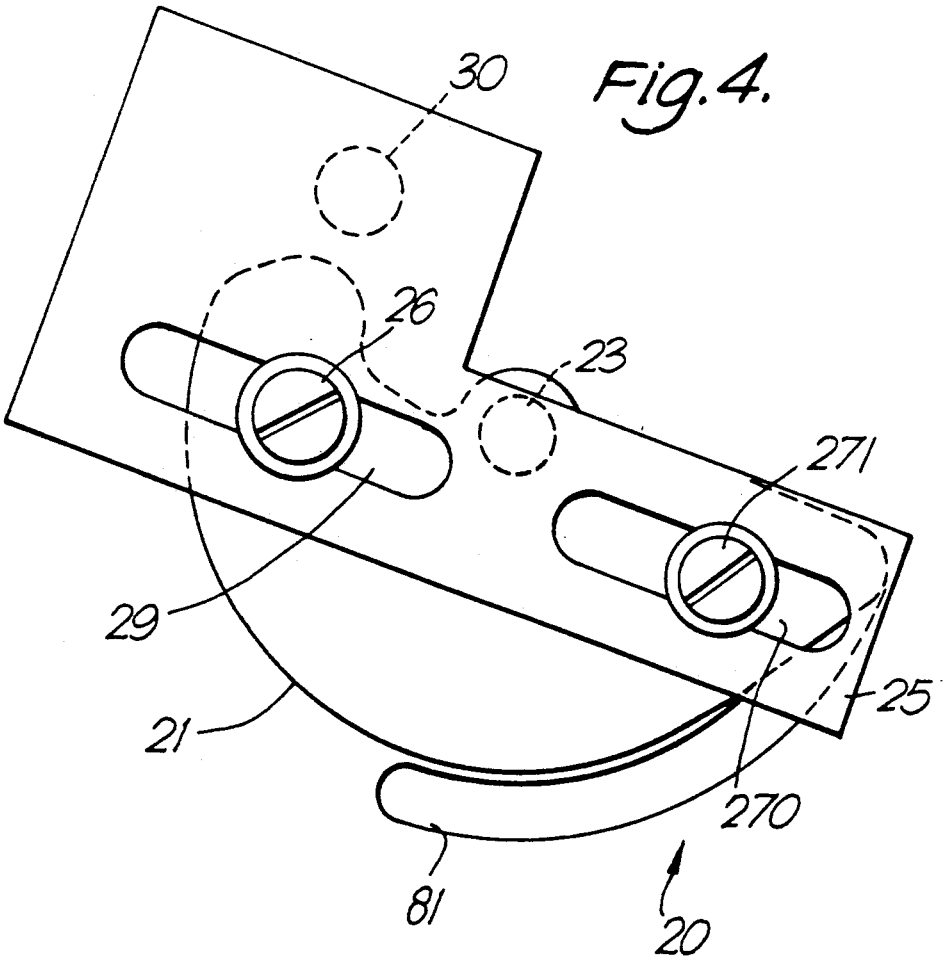
FIG. 4 is an enlarged view of the tumbler member as shown in FIG. 1.

Referring to the drawings, FIG. 1 shows a device comprises a casing 10 containing a tumbler member 20, pendulum member 40, detector 50 and slot adjuster 60. The casing 10 is covered by a cover plate (not shown). A cash box (not shown) is mounted below the casing 10; both are mounted on a base 70. A coin passing through the device is sorted by the tumbler member 20 and passes through the casing 10 to activate the detector 50.

A recess 62 in the base 70 allows coins to be inserted into an entrance slot 61. The slot adjuster 60 is a curved member 63 mounted on a bracket 64. The curved member 63 and the portion of casing 65 opposite it define an aperture 66, through which coins entering the device must pass. By rotating the curved member 63 the maximum coin size accepted into the device can be altered.

Both the tumbler member 20 and the pendulum member 40 are mounted on a mounting plate 80 that is spaced from the base 70. The tumbler member 20 comprises a backing plate 21 which is rotatably attached at a pivot 23 to the mounting plate 80. A guide pin 22 is fixedly attached to the backing plate 21 and runs in a slot 81 in the mounting plate 80 that is concentric with the backing plate pivot 23. Pin 22 thus extends across the gap between base 70 and plate 80.

A cylindrical projection or boss 24 from the backing plate 21 extends outwards and is adjustably attached in a slot 29 of a face plate 25 by a screw 26. A second cylindrical projection or boss 27 extends from the backing plate 21 and is similarly attached by a screw 271 to a second groove 270 in face plate 25.

A fixed pin 30 is attached to the rear face of face plate 25 and extends through a slot in mounting plate 80 and across the gap between base 70 and plate 80. Thus pins 22 and 30 define an aperture 28 through which undersize coins pass without activating the tumbler. Coins of the correct size are caught between pins 22 and 30. The length of the aperture 28 can be altered by loosening the screws 26 and 271 and altering their positions along groove 29 and 270 in the face plate 25.

The pendulum member 40 has a weight 41 and hangs adjacent to the tumbler 20 member on a fulcrum 43. A portion 42 of the pendulum member 40 extends above the fulcrum 43. A guide pin 44 attached to this portion 42 travels in a slot 45 in the mounting plate 80 as the pendulum member 40 swings.

The detector 50 is a microswitch 51 activated by the deflection of a wire 52. The free end of the wire 52 is turned over and travels in a groove 53 in the base 70.

Within the wall of the casing 10 is an adjustment plate 90. This can be moved in and out of the casing 10 wall to alter the effective separation between the casing 10 and the detector 50. Two grooves 91,92 are provided in the casing 10 to adjustably attach the adjustment plate 90 in position.

The casing 10 has two apertures 71,72 in its lower portion. There is a barrier 73 within the casing 10.

Coins entering the device are guided by the casing 10 walls and travel in the gap between base 70 and mounting plate 80. The coins are guided by the guide pin 44 on the pendulum member 40, into the tumbler member 20. Coins below a predetermined size pass through the aperture 28 defined by the tumbler member 20 and fall through aperture 72 in the casing 10 and into the cash box without being detected.

Coins of the predetermined size will lodge in the aperture 28. The tumbler member 20 is not balanced if a load is placed on it and tilts towards the pendulum member 40. The coin in the aperture 28 pushes against the guide pin 44 on the pendulum member 40 and displaces it from its rest position until its inclination is such that the coin would fall from the tumbler member 20, but for the support of the guide pin 44. As the inclination is increased the displacement of the pendulum member 40 increases and this increases the gap between the tumbler member 20 and the guide pin 44 until the gap is large enough to allow the coin to pass through it. Coins following this path deflect the wire 52 of the detector 50, are detected and pass through the second aperture 71 in the casing 70 and into the cash box. The barrier 73 prevents smaller coins mixing with the coins above the predetermined size.

The device uses a simple mechanical mechanism to sort coins and is robust and reliable.

The inbuilt adjustment means 26,271,60,90 in the device allow it to be modified for use with different sizes and types of coins. The maximum slot 61 size can be fixed and the length of the tumbler aperture 28 varied. The adjustment plate 90 ensures that all of the coins of the predetermined size deflect the wire 53 of the detector 50, and do not by-pass it.

There are a number of modifications that may be made to the embodiment described. In particular the tumbler 20 may be replaced by the tumbler 320 shown in FIGS. 5 and 6 and comprising a cradle 321 and a regulator plate 325 attached to the front thereof. Cradle 321 corresponds to the backing plate 21 of the first embodiment and is pivoted at 323. It has a rearward projecting pin 322 passing through slot 381 for engagement with the edge of an inserted coin and three threaded bosses 324,327 and 427 on the opposite face thereof.

Regulator plate 325 also has a rearward projecting pin 330 which extends through an aperture 430 in plate 80 for engagement with the edge of an inserted coin between base 70 and plate 80. The regulator 325 is attached to cradle by a first screw (not shown) passing through a hole 441 and into bore 324, and a second screw passing either through hole 442 into bore 327 or through one of a row of holes 443 and into bore 427. The selection of each hole 442 or 443 corresponds to a different separation of pins 322 and 330 and thus to a different denomination of inserted coin. In use, as with the first embodiment, an inserted coin passes between pin 322 of tumbler member 320 and a guide pin 344 of a pendulum member 340. In this case pin 344 extends rearwardly through a slot 345 in plate 80. Pendulum member 320 has a pivot 343.

Figure 5A:
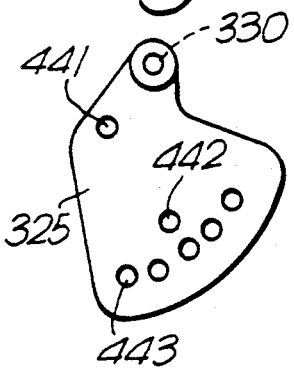
FIGS. 5*a,b* and *c* are front and side views of respective parts of a device in accordance with a second embodiment of the present invention.
Figure 5B:
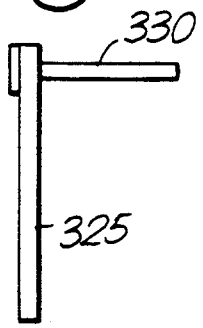
Figure 5C:
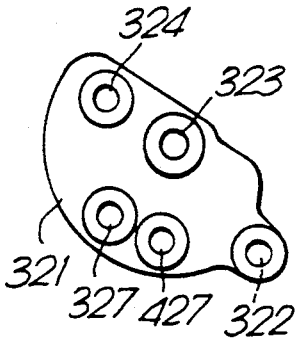
Figure 5D:
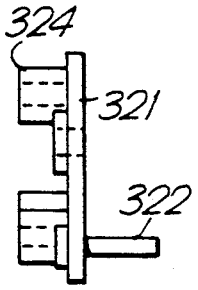
Figure 5E:
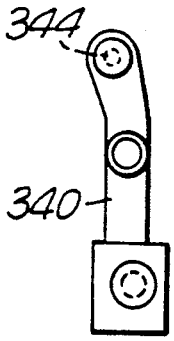
Figure 5F:
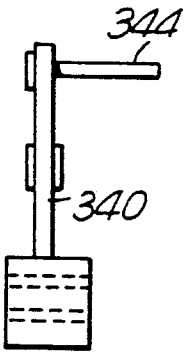
Figure 6A:
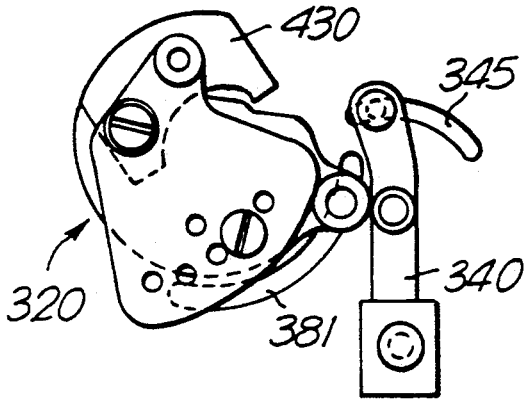
FIGS. 6*a* and are front and side views respectively of the parts of FIG. 5 when assembled.
Figure 6B:
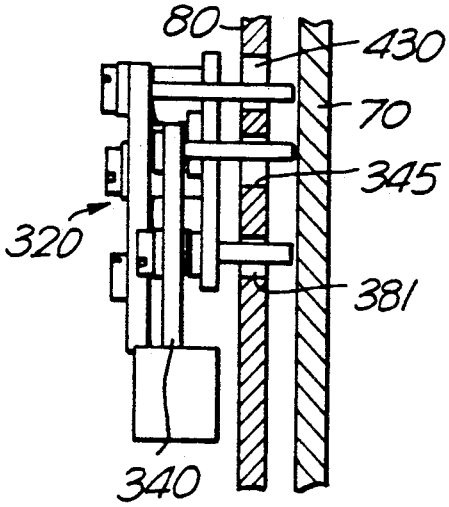

The embodiment of FIGS. 5 and 6 has the advantage that it is quicker and easier to adjust, with the required accuracy being automatically provided. The embodiment of FIGS. 1 to 4, on the other hand, has the advantage that it is not limited to prespecified coin sizes. To provide this advantage in the second embodiment, one or more of holes 441,442,443 may be replaced by a slot.

In other modifications, relative movement between the tumbler member 20 and the pendulum member 40 may actuate the detector 50. The members 20,40 may swing and then be returned to their first positions by the effects of weak return spring. Only tumbler member 20 may move, in which case pendulum 40 is replaced by a fixed part of the device.

It will be understood that the above description of the present invention is susceptible to various modifications, changes and adaptations.

What is claimed is:

1. A coin-operated device comprising means defining a path for an inserted coin, a first pivotable member located in said path and means defining a coin-receiving aperture in said first pivotable member, wherein the length of said aperture is adjustable, and wherein said first pivotable member is a tumbler comprising a pivotably mounted first plate and a second plate rotatably adjustably attached to said first plate, rotation of said second plate in discrete steps relative to said first plate causing adjustment of said aperture length; and a second pivotable member adjacent to said first pivotable member, the arrangement being such that an inserted coin of a correct denomination pivots said first and second pivotable members to cause said members to move from a position where the coin cannot pass between said members to a position where the coil can pass between said members.

2. A device according to claim 1 wherein said aperture-defining means comprises a first pin and a second pin projecting from said first and second plate respectively into said path.

3. A device according to claim 2 wherein said first and second plates are attached by means of a first connection and a second connection, one of said plates having a plurality of openings, one of said openings being aligned with a bore in the other said plate and being secured in alignment by a fastener extending through said opening and into said bore to form said second connection.

4. A device according to claim 1 wherein said second pivotable member is a pendulum having a guide pin which is located in said path of an inserted coin to guide a said coin into said aperture in said first pivotable member, and is arranged then to be contacted by said coin to cause pivoting of said pendulum.

5. A coin-operated device comprising means defining a path for an inserted coin, a first pivotable member located in said path, means defining an adjustable coin-receiving aperture in said pivotable member, and a second pivotable member mounted adjacent to said first pivotable member, the arrangement being such that an inserted coin of a correct denomination pivots said first and second pivotable members to cause said members to move from a position in which the coin cannot pass between said members to a position in which the coin can pass between said members, said pivotable member being a tumbler comprising a pivotably mounted first plate and a second plate adjustably attached to said first plate, said aperture-defining means comprising a first pin and a second pin projecting from said first and second plate respectively into said path, said second plate being adjustable in discrete steps relative to said first plate, whereby to adjust the length of said aperture, said first and second plates are attached by means of a first connection and a second connection, one of said plates having a plurality of openings, one of said openings being aligned with a bore in the other said plate and secured in alignment by a fastener extending through said one of said openings into said bore to form said second connection, said openings being arranged in at least two rows, each row comprising at least one opening, there being provided at least two bores on the other said plate, and wherein said second pivotable member is a pendulum having a guide pin which is located in said path of an inserted coin, to guide a said coin into said aperture in said first pivotable member, and is arranged then to be contacted by said coin to cause pivoting of said pendulum.

6. A coin-operated device comprising:

means defining a path for an inserted coin;

a first pivotable member located in said path and means defining coin-receiving aperture in said pivotable member, wherein the length of said aperture is adjustable, and wherein said first pivotable member is a tumbler comprising a pivotably mounted first plate and a second plate adjustably attached to said first plate, adjustment of said second plate relative to said first plate causing adjustment of said aperture length, and wherein said first and second plates are attached by means of a first connection and a second connection, one of said plates having at least one opening, at least a portion of said at least one opening being aligned with a bore in the other said plate, and being secured in alignment by a fastener extending through said opening and into said bore to form said second connection; and a second pivotable member mounted adjacent to said first pivotable member, the arrangement being such that an inserted coin of a correct denomination pivots said first and second pivotable members to cause said members to move from a position where the coin cannot pass between said members to a position where the coin can pass between said members.

7. The device of claim 6 wherein said one of said plates includes a plurality of openings, one of said plurality of openings being aligned with said bore in the other said plate, and being secured in alignment by a fastener through said one of said openings and into said bore to form said second connection.

8. The device of claim 6 wherein said one of said plates includes first and second openings, at least a portion of each of said first and second openings being aligned with first and second bores in the other said plate, and being secured in alignment by first and second fasteners extending through said first and second openings and into said first and second bores to form said first and second connections.

9. The device of claim 6 wherein said second pivotable member is a pendulum having a guide pin which is located in said path of an inserted coin, to guide said coin into said aperture in said first pivotable member, and is arranged then to be contacted by said coin to cause pivoting of said pendulum.

10. A device according to claim 6, wherein said second plate is rotatably adjustable relative to said first plate.

11. A device according to claim 6, wherein said second plate is adjustable continuously relative to said first plate.

* * * * *

UNITED STATES PATENT AND TRADEMARK OFFICE

CERTIFICATE OF CORRECTION

PATENT NO. : 5,076,415

DATED : December 31, 1991

INVENTOR(S) : John B. Angel

It is certified that error appears in the above-identified patent and that said Letters Patent is hereby corrected as shown below:

Column 1, line 2-3, "COIN OPERATED DEVICEcl BACKGROUND OF THE INVENTION" should read as two separate headings as follows:

--COIN OPERATED DEVICE

BACKGROUND OF THE INVENTION--.

Column 1, line 51, "FIGS. 5a, b and c are" should read --FIGS. 5a-5f--.

Column 1, line 54, "FIGS. 6a and are" should read --FIGS. 6a and b are front--.

Column 5, line 26, "means defining coin-receiving" should read --means defining a coin-receiving--.

Signed and Sealed this

Twentieth Day of July, 1993

*Attest:*

Michael K. Kirk

MICHAEL K. KIRK

*Attesting Officer*

*Acting Commissioner of Patents and Trademarks*